United States Patent [19]

Cobb

[11] 4,208,948

[45] Jun. 24, 1980

[54] HIGH EFFICIENCY PROPULSION SYSTEM

[75] Inventor: Bernie J. Cobb, Huntsville, Ala.

[73] Assignee: The United States of America as represented by the Secretary of the Army, Washington, D.C.

[21] Appl. No.: 963,065

[22] Filed: Nov. 22, 1978

[51] Int. Cl.[2] ..... F41F 15/00

[52] U.S. Cl. ..... 89/1.706

[58] Field of Search ..... 89/1.7, 1.703, 1.704, 89/1.705, 1.706, 1.8, 1.878, 8

[56] References Cited

U.S. PATENT DOCUMENTS

| | | | |
|---|---|---|---|
| 2,834,255 | 5/1958 | Musser | 89/1.706 |
| 3,008,378 | 11/1961 | Musser | 89/1.704 X |
| 3,338,133 | 8/1967 | Grandy | 89/1.706 X |
| 3,490,330 | 1/1970 | Walther | 89/1.706 X |
| 3,653,288 | 4/1972 | Stauff et al. | 89/1.703 |

FOREIGN PATENT DOCUMENTS

| | | | |
|---|---|---|---|
| 1124434 | 7/1956 | France | 89/1.703 |

*Primary Examiner*—David H. Brown

*Attorney, Agent, or Firm*—Nathan Edelberg; Robert P. Gibson; James T. Deaton

[57] ABSTRACT

A high efficiency propulsion system for launching a rocket or projectile with higher delivered specific impulse than can be delivered with a given propellant using a conventional rocket or recoilless gun and still maintain a recoilless launch condition.

5 Claims, 3 Drawing Figures

HIGH EFFICIENCY PROPULSION SYSTEM

DEDICATORY CLAUSE

The invention described herein may be manufactured, used, and licensed by or for the Government for Governmental purposes without the payment to me of any royalties thereon.

BACKGROUND OF THE INVENTION

Antitank weapons such as DRAGON, VIPER and the 90 mm Recoilless Rifle achieve their primary velocity in the launch tube. In the case of DRAGON other propulsive means are used to sustain rocket velocity. This means that the propellant must be expended in a short time so that the combustion pressures are not excessive when the rocket or projectile exists the muzzle of the launcher. At present, recoilless rifle design demands relatively large throat area in order that sufficient propellant gases are discharged to the rear to counter balance the opposing (forward) projectile momentum. Some of these recoilless designs use a combined nozzle closure/shot start device. But in these devices, when the nozzle closure is released the effect of full nozzle opening is immediate and gas flow is controlled by the full nozzle throat. This of course places considerable stresses on the propellant being used to drive the projectile. In order to get high projectile velocity with reasonably short launch tubes, high operating pressure is required. High operating pressure in turn requires large propellant burning surface area. When the requirements for large throat and burning surface areas are coupled, very thin propellant webs result. Thin web propellant is subject to breakage, especially at cold temperatures. To overcome this problem, fiber reinforced propellant has been explored but showed little improvement. In addition, high pressure drives the motor case weight up and reduces efficiency of the rocket. Therefore, there is a need for a device which can accelerate a rocket or projectile to high velocity, while maintaining the recoilless feature of the launcher, and overcome the attendant propellant break-up problem.

Accordingly, it is an object of this invention to provide a high efficiency propulsion system which overcomes difficulties associated with other devices of this type and still accelerate a rocket or projectile to the required high velocity, thus demonstrating the high propulsion efficiency through delivered specific impulse (muzzle velocity×rocket or projectile muzzle mass÷propellant weight).

Another object of this invention is to provide a high efficiency propulsion system that can be used as a training device at low cost.

Still another object of this invention is to provide a high efficiency propulsion system in which the flow path for the gases produced from the buring propellant is such that any broken propellant will tend to be trapped and caused to burn before reaching the throat section of the combustion chamber.

Yet another object of this invention is to provide a high efficiency propulsion system in which the launch tube can be used many times by replacing only the rocket or projectile and gas generator with its appropriate ingniter means which causes launching of the projectile.

Other objects and advantages of this invention will be obvious to those skilled in this art.

SUMMARY OF THE INVENTION

In accordance with this invention, an inner launch tube is secured to an outer tube in a conventional manner and the inner launcher tube has a bore therethrough with an enlarged bore at one end that is treaded adjacent to the joint between the larger and smaller diameter bores of the inner launch tube. A projectile has a shear washer mounted thereon and the projectile is positioned in the inner launch tube with a gas generator clamping the projectile at the shear washer to the inner launch tube. The gas generator has high burning rate propellant therein and the projectile has a tracer charge therein if desired. Alternatively, a rocket with sustain motor could replace the projectile illustrated. An igniter is provided in a conventional manner for igniting both the propellant of the gas generator and tracer charge or rocket sutain propellant. Elongated slots are provided in a sleeve around the projectile or in a portion of the gas generator structure or slots are provided in each of these members. The slots may be opened when the gas generator is ignited or they may be closed and only opened progressively as the projectile moves out the inner launch tube. A flow path for the gases from the gas generator is provided through the slots in the sleeve and gas generator structure and through a space between the larger diameter bore of the inner launch tube and the outer surface of the gas generator body that defines a throat for the launcher. As can be seen, gases from the gas gas generator must make a 180° turn before exiting the throat from the rocket launcher.

DESCRIPTION OF THE PREFERRED EMBODIMENT

Figure 1:
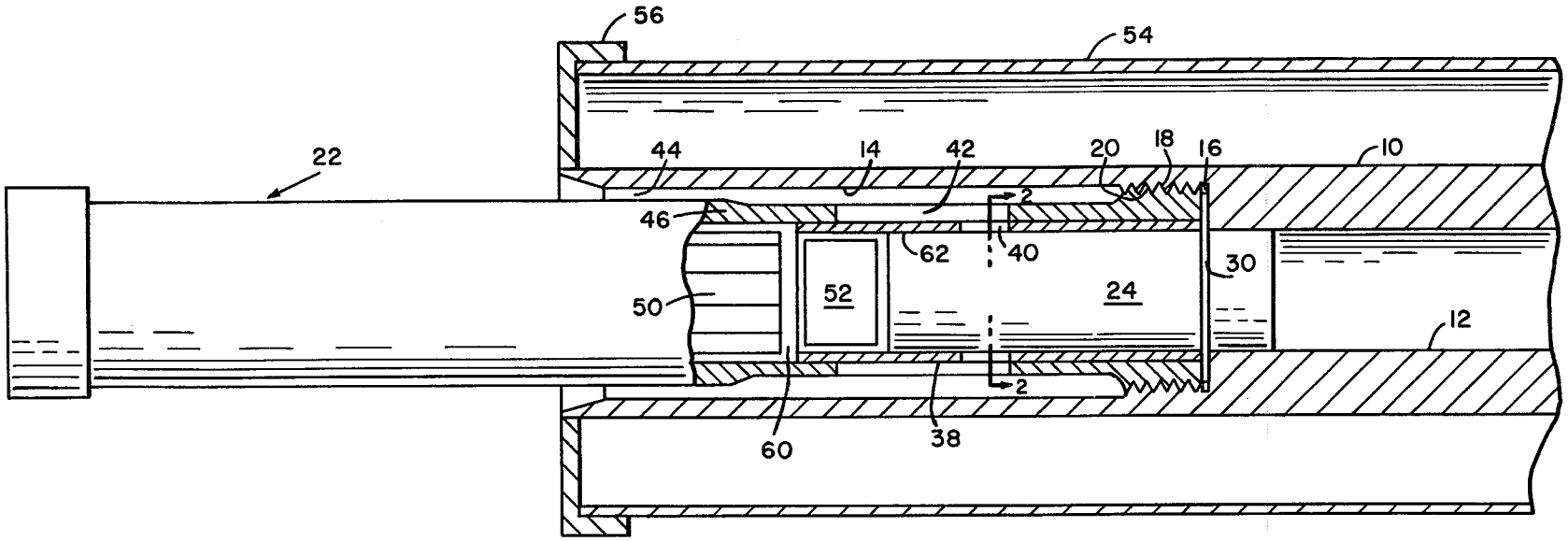
FIG. 1 is a view of the high impulse rocket launcher in accordance with this invention and showing portions of the launcher in section and other portions as cut away.
Figure 2:
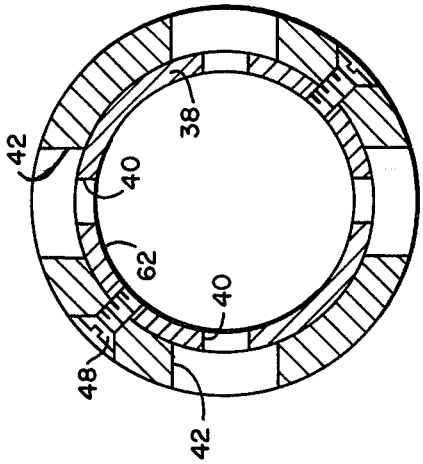
FIG. 2 is a sectional view along line 2—2 of FIG. 1 with the projectile omitted.
Figure 3:
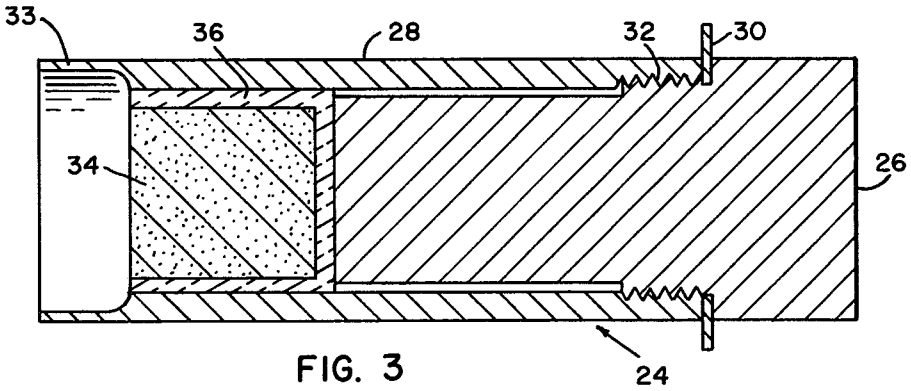
FIG. 3 is a sectional view of a projectile used in the rocket launcher in accordance with this invention.

Referring now to the drawing, an inner launch tube 10 includes a first bore 12 and an enlarged bore 14. A ledge 16 is defined between bores 12 and 14 and bore 14 is threaded at 18 for engagement with threads 20 on gas generator 22. Projectile 24 is made with two body parts including a nose section 26 and a cylindrical body section 28 that have a shear washer 30 clamped therebetween by thread means 32. Tube 28 has obturator lip 33 at one end and a tracer charge 34 mounted inside insulation liner 36 to cause tracer charge 34 to burn from a single surface. Projectile 24 is clamped in launch tube 10 by thread means 20 on gas generator 22 and threads 18 in launch tube 10 to clamp shear washer 30 against shoulder 16. As illustrated, projectile 24 has a blunt nose, but any other desired shapes may be used. A sleeve 38 may be positioned around projectile 24 with slots 40 of predetermined length and widths that are located relative to larger slots 42 in gas generator 22. The length and size of slots 40 determine how far projectile 24 travels before gases from gas generator 22 are exhausted through throat 44 that is defined between an outer enlarged surface of gas generator body 46 and inner bore 14 of inner launch tube 10. Slots 40 can be of such length as to have the flow passage acutally open when gas generator 22 is ignited if desired. By using sleeve 38, adjustability as to when the gases will be exhausted can be built into the device and when sleeve 38 is used, conventional securing means such as 48 are used to secure sleeve 38 to the housing structure 46 of gas generator 22. If adjustability is not desired, sleeve 38 can be dispensed with and the exact size of the slots can be placed directly in body 46 by the specific shape of slots 42.

Gas generator 22 has high burning rate propellant 50 mounted at the rear end and can be conventional high burning rate propellant of the double base type, conventional composite propellant or for example sheet composite propellant with a carborane additive. In any case, the propellant is such that high operating pressures are reachecd quickly in order to impart high projectile velocity with reasonably short launch tubes. This of course requires high operating pressure and in turn large propellant burning surface area is required. With this requirement, very thin propellant webs result and are subject to breakup as the propellant is burning. A conventional igniter 52 located between propellant 50 and tracer charge 34 has conventional means connected thereto (not shown) for causing igniter 52 to ignite propellant 50 and tracer charge 34 when it is desired to fire the projectile. Also, as illustrated inner launch tube 10 is integrally connected to an outer tube 54 by end cap 56 and other appropriate structure since inner launch tube 10 is being adapted when used with the outer launch tube as a training type device. If desired, inner launch tube 10 can be the only tube of the launcher. In either case, the launcher has conventional means which is not illustrated for shoulder firing of the projectile from the rocket launcher.

In operation, igniter 52 is ignited in a conventional manner to ignite propellant 50 and trace charge 34. After a predetermined pressue build-up in chamber 60, obturator lip 33 expands to seal against inner surface 62 of sleeve 38 of gas generator body 46, shear washer 30 is sheared and projectile 24 increases in velocity as it moves out bore 12. After projectile 24 has moved a predetermined distance, slots 40 are open and gas from chamber 60 is exhausted through slots 40 and 42 into the space between enlarged diameter 14 and the outer surface of gas generator 22 and finally through annular throat 44 to exhaust. As can be seen, gases from the propellant in chamber 60 must turn 180° before being exhausted at throat 44. This causes more complete propellant burning before exhaust.

During this process, the propellant gases cause very high acceleration of projectile 24 due to the high pressures generated in chamber 60 and with the high pressures that have been initially generated, the propellant can now continue to burn at a very high rate. As propellant 50 continues to burn, if any break up of the propellant occurs, due to the long path from the propellant in chamber 50 to throat 44, this propellant will be caught in this path and caused to burn before exiting through annular throat 44. With this arrangement, by exhausing the pressure through slots 40 and throat 44, a recoilless device results. This rocket launcher has higher delivered specific impulse with a given propellant than with a conventional rocket or recoilless gun. For example, in a reocilless gun the specific impulse ranges from about 150–175 pound-second/pound; for a rocket, about 210–240 pound second/pound; and for this rocket launcher over 300 pound-second/pound has been obtained. As previously noted, this invention can be used and adapted for a low cost training device wherein tracer charge 34 of the projectile allows the person firing the launcher to visually trace the course of the projectile. Even though projectile 24 has been illustrated as a non-spinning finless projectile, this projectile could have low spin rates imparted thereto by cutting helical grooves in sleeve 38 and by providing indexing means on the projectile. Also, if a larger bore diameter type launch tube is desired, the projectile could contain sabot means to provide for a projectile that would contain fins.

I claim:

1. A high efficiency propulsion system comprising a launch tube having a bore therethrough, a shoulder defined in said launch tube, a projectile having shear means thereon and mounted in said bore with said shear means against said shoulder, and gas generator means securing said shear means against said shoulder, said gas generator means having propellant in a chamber thereof, a passage from said chamber that is open to the atmosphere when said shear means has been sheared and said projectile has been caused to move away from said gas generator means, said passage being open to the atmosphere by a throat defined between an outer surface of said gas generator means and said bore, and igniter means for igniting said propellant to cause said projectile to be launched at high impulse.

2. A high efficiency propulsion system as set forth in claim 1, wherein said passage from said chamber causes gases from said gas generator means to be turned approximately 180° to aid in burning of the propellant before exhaust gases exhaust through said throat.

3. A high efficiency propulsion system as set forth in claim 1, wherein a sleeve is placed inside a bore of said gas generator means and surrounds said projectile, said passage including slots elongated in said sleeve that open into elongated slots of larger dimension in said gas generator means and means securing said sleeve and gas generator slots in a predetermined relationship.

4. A high efficiency propulsion system as set forth in claim 1, wherein said projectile has a tracer charger mounted in one end and said igniter means is used to ignite both the propellant and tracer charger at the same time.

5. A high efficiency propulsion system as set forth in claim 1, wherein said gas generator means securing said shear means against said shoulder is removable so that said launch tube can be reloaded with a new projectile and gas generator means and used many times.

* * * * *